United States Patent [19]

Moretti

[11] 4,236,514

[45] Dec. 2, 1980

[54] RESPIRATION SYSTEM

[75] Inventor: Anthony L. Moretti, San Rafael, Calif.

[73] Assignee: E. D. Bullard Company, Sausalito, Calif.

[21] Appl. No.: 51,372

[22] Filed: Jun. 25, 1979

[51] Int. Cl.[3] ..... A62B 17/04

[52] U.S. Cl. ..... 128/201.23; 2/2.1 A; 2/205; 2/6

[58] Field of Search ..... 128/201.23, 201.29, 128/201.25, 201.22, 201.24, 201.26, 201.27, 201.28; 2/2.1 A, 205, 6

[56] References Cited

U.S. PATENT DOCUMENTS

| | | | |
|---|---|---|---|
| 1,928,238 | 9/1933 | Willson et al. | 2/205 |
| 3,911,914 | 10/1975 | Johansson | 128/201.23 |
| 4,052,984 | 10/1977 | Brockway | 128/201.23 |

OTHER PUBLICATIONS

30 CFR Title 30, Subpart J., pp. 43–44.
E. D. Bullard Co. Product Literature: "System 999".
3M Co. Product Literature, "W-2810".
3M Co. Product Literature, "Economy Systems".

*Primary Examiner*—Henry J. Recla
*Attorney, Agent, or Firm*—Phillips, Moore, Weissenberger, Lempio & Majestic

[57] ABSTRACT

A respiration system is provided which is useful to protect a wearer thereof in potentially hazardous atmospheres which are not immediately dangerous to life or health. The respiration system comprises a flexible cape member having an aperture defining a neck engaging collar through which a wearer's head is passed. A ring structure surrounds the aperture and is attached to the cape member to form and hold an inner portion of the cape member in a ruff configuration which extends radially outwardly from the aperture to the ring structure. A conduit passes through a first orifice in the cape member, within the inner portion thereof, for release of respiratory air above an upper surface of the ruff configuration. A head enclosure is sealing affixed to the cape member and surrounds the ruff configuration.

14 Claims, 6 Drawing Figures

RESPIRATION SYSTEM

BACKGROUND OF THE INVENTION

1. Field of the Invention

The present invention relates to protective clothing, particularly to respiration systems thereof useful in atmospheres not immediately dangerous to life or health.

2. Prior Art

A variety of respiration systems are known which provide protection against hazardous atmospheres in which a wearer of the respiration system is to work. Some such atmospheres may be immediately dangerous to life or health, and respiration systems for use therein frequently include specialized, relatively extensive and cumbersome head enclosures, respiration systems and body suits.

However, many atmospheres may require respiratory protection for working therein, particularly during extended periods, but are not so immediately dangerous to life or health; thus, if necessary, the wearer of a respiration system therein could escape without the aid of the respiration system. Examples of such less immediately dangerous atmospheres are those containing certain low levels of radioactive contamination or of corrosive chemicals. For these latter, potentially hazardous atmospheres, the prior art respiration system constructions have not been found to be adequate.

It is an object of the present invention to provide a respiration system which is comfortable to wear and intrudes as little as possible upon a wearer's full spectrum of body motions, such as for example bending, stretching, tool manipulation and the like.

It is a further object of the present invention that portions of the respiration system exposed to normal contamination be easily and inexpensively replaced, and that the respiration system be adaptable for assemblage with a variety of head enclosure and protective, body enclosing constructions and configurations, as the particular working environment may dictate.

Finally, it is an object of the present invention that the respiration system have a relative low noise level from the releasing air, and that the wearer of the respiration system receives the full benefit and maximum flow of air for breathing thereof.

SUMMARY OF THE INVENTION

The respiration system of the present invention is directed to providing one or more of the above-noted desirable objectives.

In one aspect of the present invention, a respiration system comprises a flexible cap member, a ring structure, attachment means and a head enclosure. The cape member is flexible, and has opposed first and second surfaces. The cap member defines an aperture therethrough and a first orifice therethrough. The aperture is a neck engaging collar. The ring structure is for surrounding the aperture and first orifice and an attachment means is used to attach the ring structure to one of the cape member surfaces. When attached, the ring structure and attachment means co-operate to hold an inner portion of the cape member in a radially outwardly extending ruff configuration with respect to the aperture. The head enclosure is sealingly affixed to one of the cape member surfaces to surround the ruff configuration.

Another aspect of the present invention is the manner by which the above noted cape member, particularly the inner portion and aperture thereof, is formed.

BRIEF DESCRIPTION OF THE DRAWINGS

The foregoing and other objects, features and advantages of this invention will be more clearly understood from a reading of the following specification with reference to the accompanying drawings wherein.

BEST MODE FOR CARRYING OUT THE INVENTION

General Description

Two preferred embodiments of this invention are hereinafter described, each of which provides a respiration system in accordance with the present invention which is comfortable to wear, and intrudes as little as possible upon a wearer's full spectrum of body motions. The FIGS. 1–5 embodiment, hereinafter denoted as respiration system 10, is the best mode contemplated for practice of the present invention. However, the FIG. 6 embodiment of this invention, denoted hereinafter as respiration system 100, is also directed to providing one or more of the previously described, desirable objectives.

Detailed Description of FIGS. 1–5 Embodiment

Figure 1:
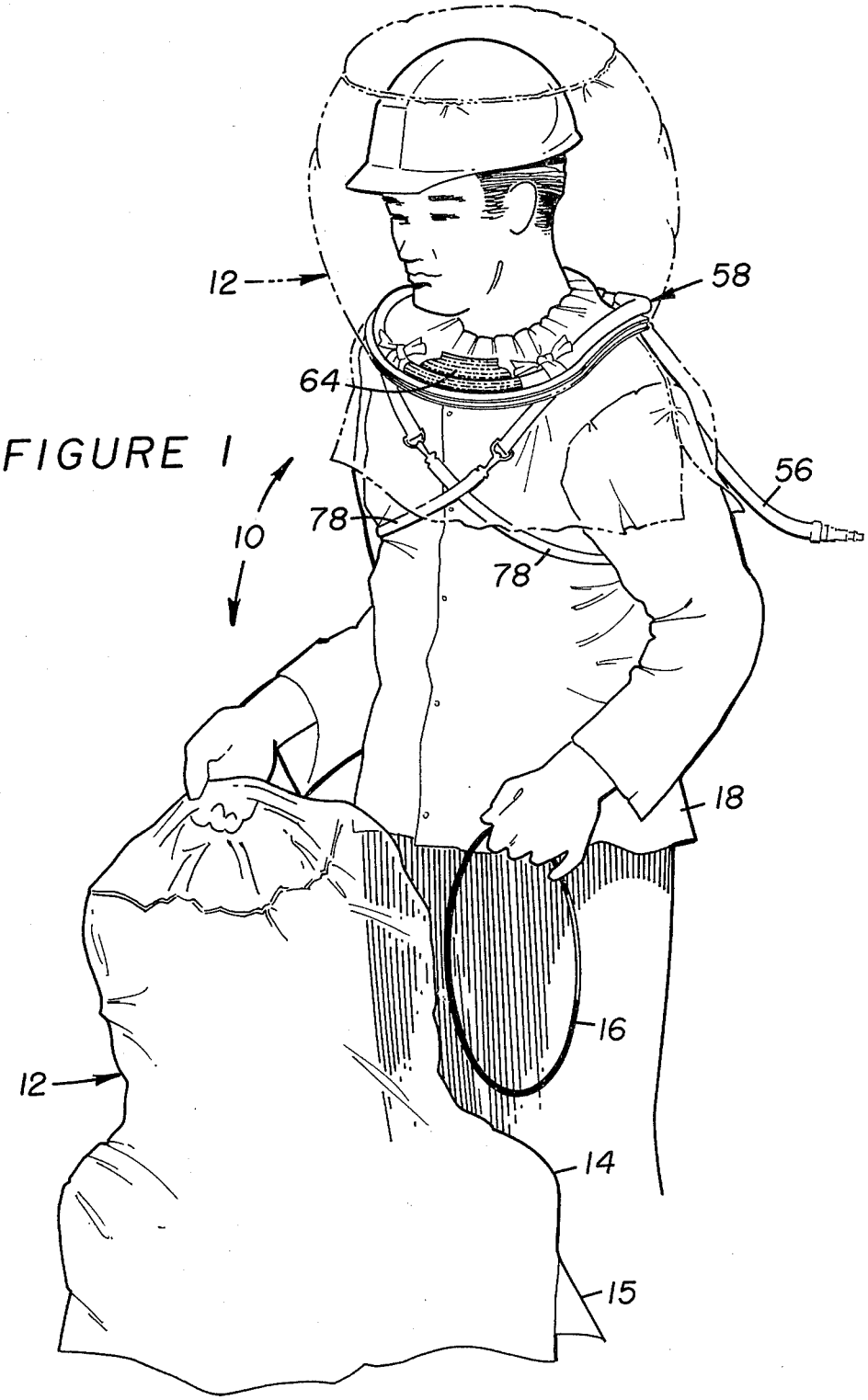
FIG. 1 is a perspective view of a respiration system according to a preferred embodiment of the present invention, a portion thereof being upon a wearer, and another portion thereof being illustrated both as held in the wearer's hands and in phantom as upon the wearer.

Referring to FIG. 1, the respiration system 10 is illustrated with a portion thereof, or a head enclosure 12, being held in the hand of a wearer before full operational assembly of the respiration system 10. Full operational assembly is indicated in FIG. 1 by the phantom representation of head enclosure 12 installed about the wearer's head. The head enclosure 12 may be a variety of longitudinally extending head enclosures, or hoods, as best suited for the particular work activity, to define a plenum of respiratory air about the wearer's head. However, the head enclosure 12 should be of sufficient longitudinal extension so that a shoulder portion 14 thereof will be adjacent the wearer's shoulders when the head enclosure 12 is placed over the wearer's head.

The head enclosure 12 is herein illustrated as extending beyond shoulder portion 14 (being split thereafter to permit upper arm movements) to define an outer cape portion 15 of head enclosure 12. The head enclosure 12 is preferably formed of an optically clear plastic, and includes an elastomeric member 16 for the operative assemblage of head enclosure 12 with the remaining portion of respiration system 10. Such operative assemblage is hereinafter further described. The wearer of respiration system 10 will normally have his or her trunk and extremities protectively clothed by one or more garments chosen from various protective clothes. A coat 18 is herein illustrated as part of such protective clothes.

Figure 2:
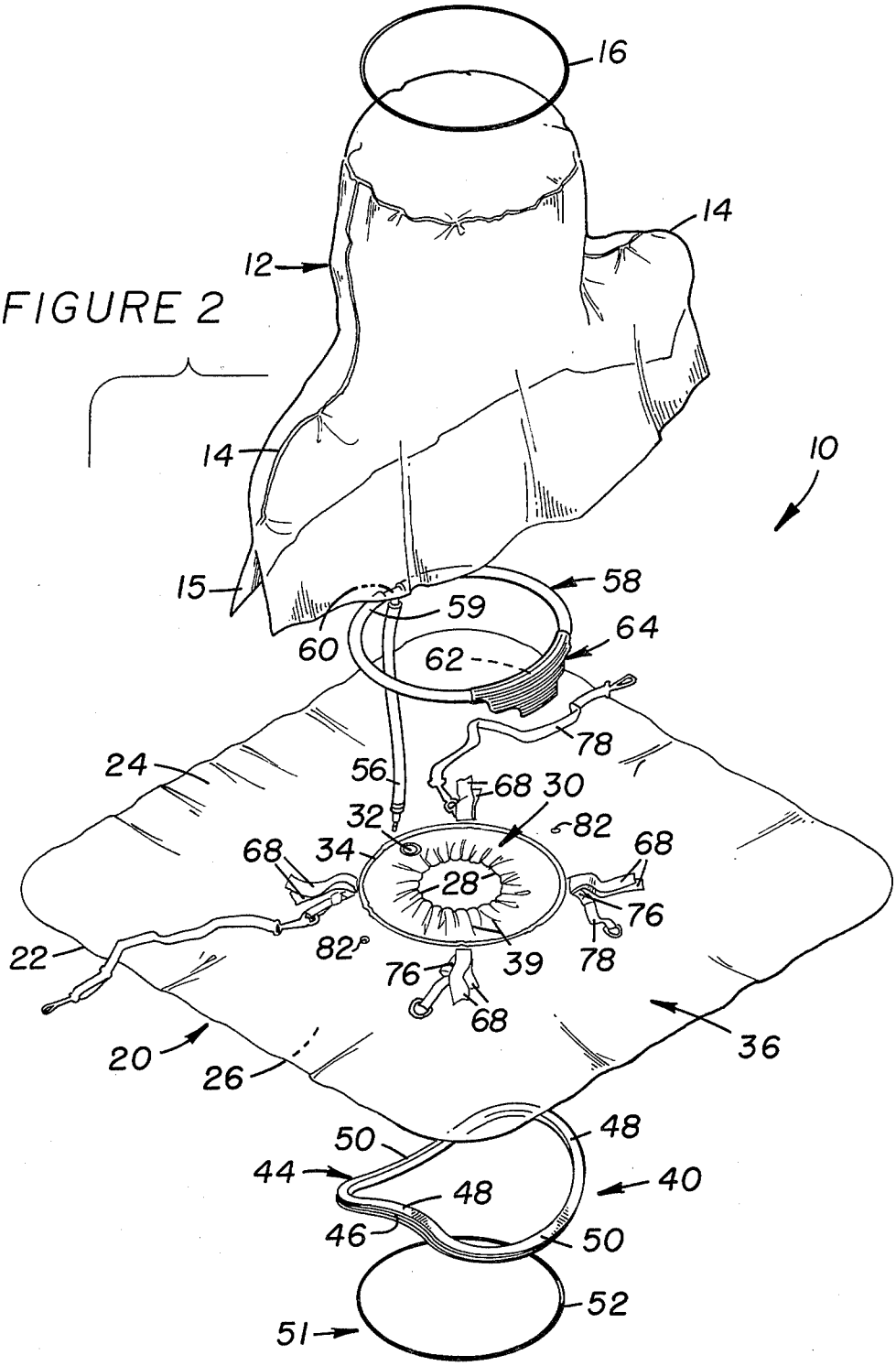
FIG. 2 is a perspective, exploded view of the respiration system according to the embodiment of FIG. 1.

Turning to FIG. 2, the respiration system 10 further comprises a flexible cape member 20 formed of an air impervious material, such as for example lightweight plastic. The cape member 20 has a peripheral edge 22, a first, or upper surface, 24, and an opposed, or lower surface 26. An annular inner portion 30 of cape member 20 includes an aperture 28 and a first orifice 32. Both the aperture 28 and the first orifice 32 pass between the surfaces 24,26 of cape member 20.

The inner portion 30 has a circumferential edge 34 being radially outward with respect to aperture 28. The circumferential edge 34 is contiguous with an outer portion 36 of cape member 20, the outer portion 36 extending outwardly to the peripheral edge 22 of cape member 20. The first orifice 32 is offset from aperture 28. Aperture 28 is of a construction sufficient to define a neck engaging collar so that the wearer's head may be passed therethrough so as to rise above the first, or upper surface, 24, and so that aperture 28 snugly encircles the wearer's neck. Such construction for aperture 28 may comprise an elastic circlet 38 (illustrated in FIG. 3), having a circumference slightly greater than that of an average wearer's neck size, inserted into the inner portion 30 adjacent aperture 28.

Figure 3:
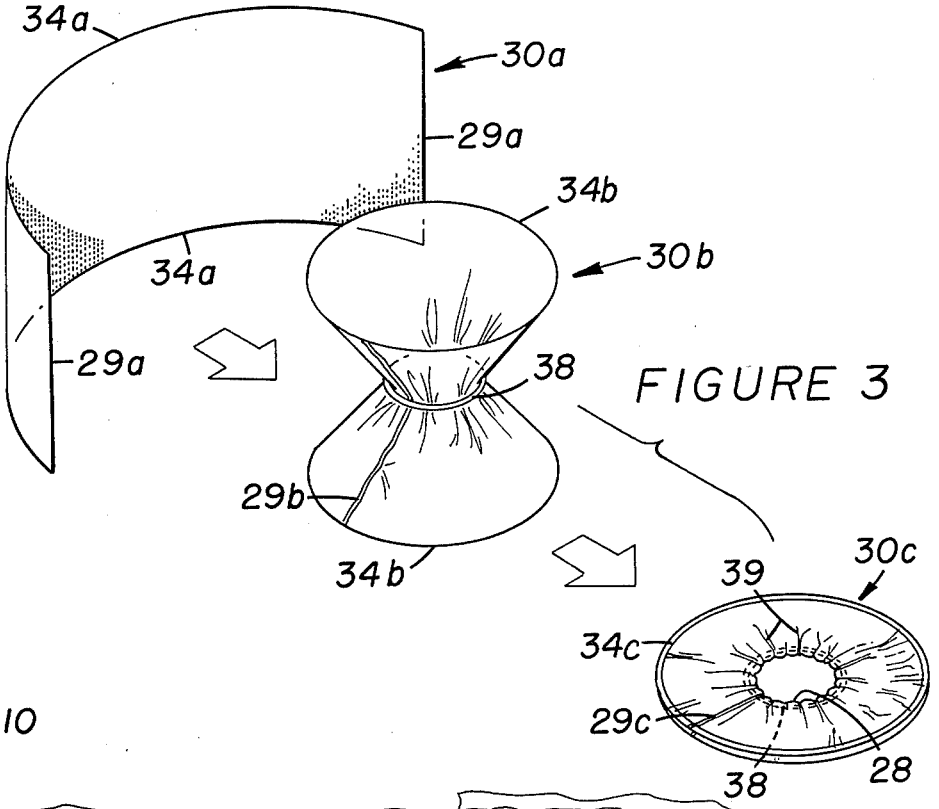
FIG. 3 is a perspective view showing a structure detail and its fabrication in accordance with the present invention.

Referring to FIG. 3, the construction for aperture 28, particularly the formation of inner portion 30 having aperture 28 therein, is preferably formed in the following manner. An air impervious, flexible rectangular sheet 30*a* has a pair of opposed ends 29*a* and a pair of opposed sides 34*a*. Ends 29*a* are brought together in an overlapping relationship and sealed together, such as by heat sealing. This forms a tube 30*b* with a length 29*b*, and a pair of open, circumferential ends 34*b*. An elastic circlet 38 is assembled over the tube 30*b* and positioned to be midway therealong. The elastic circlet 38 is of smaller diameter than the tube 30*b* and hence gathers the tube 30*b* into an hourglass like configuration. The opposed circumferential ends 34*b* are then brought together over the elastic circlet 38 to encase elastic circlet 38 therebetween and to form an annular disc 30*c* having radial dimension 29*c*. The two circumferential ends 34*b* are then sealed, such as by heat sealing, together to form the circumferential edge 34*c* of inner portion 30.

Returning to FIG. 2, the above-described, preferred formation of inner portion 30 is then incorporated into cape member 20 by the addition of outer portion 36, and the formation of first orifice 32. As may be understood, the outer portion 36 may be sealed to circumferential edge 34*c* either simultaneously with the sealing together of circumferential ends 34*b*, or subsequent thereto. It has been found that when aperture 28 and inner portion 30 are formed by the preferred process, the following advantage is achieved. Gathers 39 which radiate outwardly from aperture 28, due to the neck engaging but head passing construction, do not tend to extend as far as circumferential edge 34. Thus, an airtight seal may be readily formed between the inner portion 30 and the outer portion 36 of member 20 without puckering and without possible air escape pockets being formed along circumferential edge 34.

Referring to FIG. 2, the respiration system 10 further comprises a ring structure 40 of sufficient size to surround both the aperture 28 and the first orifice 32. The ring structure 40 of embodiment 10 includes an annulus 44 having an exterior, circumferentially extending groove 46 therein. The annulus 44 is formed in a saddle-like conformation with a pair of opposed, undulating portions, or crests, 48 and a pair of opposed, undulating portions, or troughs, 50. The crests 48 function to comfortably ride upon and fit over the wearer's shoulders. The troughs 50 function to comfortably ride upon and fit across the wearer's chest and back. The annulus 44 is of a rigid material relative to cape member 20. Preferably, the annulus 44 is formed of a lightweight metal, such as for example aluminum.

The respiration system 10 further comprises an attachment means 51 for attaching the ring structure 40 to one of the upper and lower surfaces 24,26. The attachment means 51 of respiration system 10 may simply be an elastic ring 52 of sufficient construction to be snugly received within the groove 46 of annulus 44. Elastic ring 52 is received within the groove 46 after the cape member 20 has first been passed over the groove 50 with the lower surface 26 facing inwardly against the groove 46 and the upper surface 24 facing outwardly from the groove 46. The layering arrangement of elastic ring 52, cape member 20 and groove 46 are best seen in FIG. 5.

Figure 4:
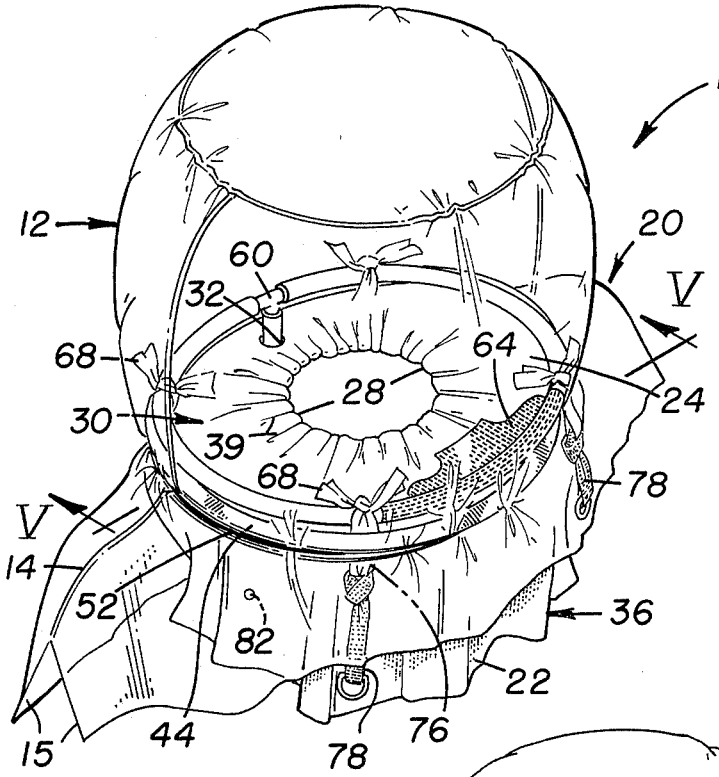
FIG. 4 is a perspective view similar to that of FIG. 2, but differing in that the elements thereof have been assembled.

Turning to FIG. 4, the annulus 44 and elastic ring 52 co-operate to hold the inner portion 30 of cape member 20 in a radially outwardly extending ruff configuration with respect to the aperture 28. In this ruff configuration, as provided in embodiment 10 by the annulus 44 and elastic ring 52, when the wearer's head is passed through the aperture 28, the inner portion 30 will extend radially outwardly from the aperture 28 to the annulus 44. Thus, the inner portion 30 substantially isolates the wearer's head from the wearer's trunk with respect to a transverse body plane thereof.

Figure 5:
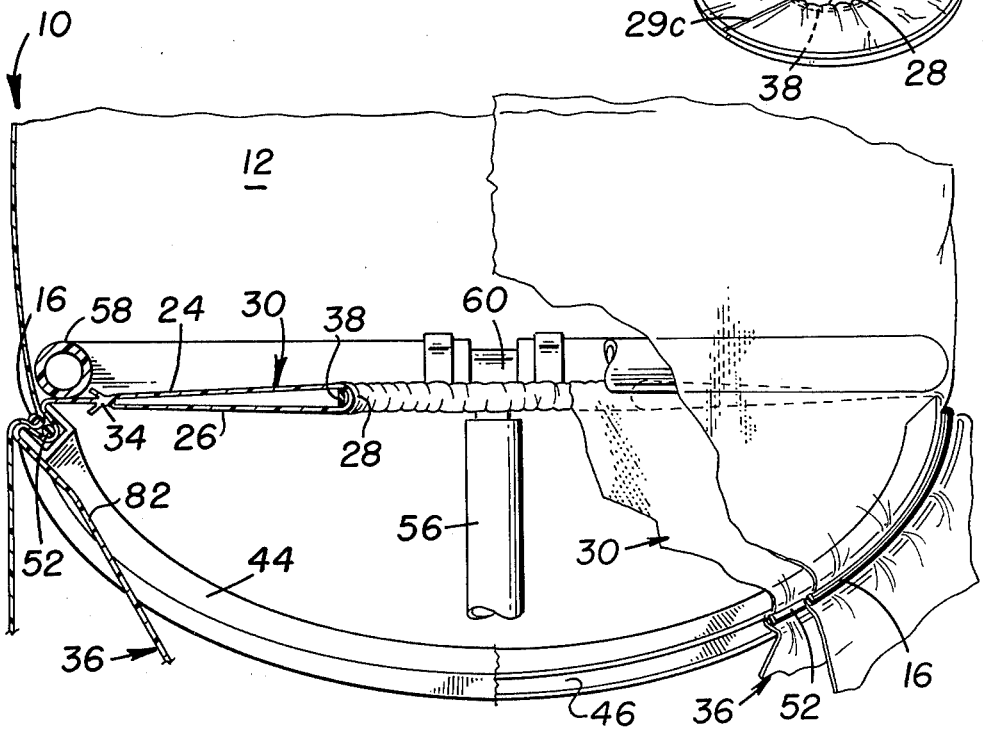
FIG. 5 is a cross-sectional detail taken along lines V—V of FIG. 4; and, FIG. 6 is a perspective view of another embodiment of the present invention.

Referring to FIGS. 4 and 5, the head enclosure 12 is positioned to surround the ruff configuration of inner portion 30 and is operatively associated therewith. Referring to FIG. 5, the operative association for embodiment 10 is whereby the head enclosure 12 is releasably, sealingly affixed to the upper surface 24 of cape member 20. This is accomplished in embodiment 10 by the elastomeric member, or ring, 16 which is stretched over the head enclosure 12 and snugly engaged into the groove 46 of annulus 44. Thus, as may be understood, the groove 46 is of sufficient size to receive both of the elastic rings 16,52 as well as the layers of cape member 20 and head enclosure 12. FIG. 1 also illustrates in the phantom representation thereof the head enclosure 12 being sealing affixed by elastomeric member 16.

Returning to FIG. 2, the respiration system 10 further comprises a first conduit 56 being of sufficient construction to channel respiration air through the first orifice 32 from the lower surface 26 to the upper surface 24 of the cape member 20. The first conduit 56 is of a diameter with respect to the diameter for first orifice 32 as to be passed loosely through first orifice 32. Such loose passage provides that the first orifice 32 functions to permit the continuous escape of air from about the head of the wearer of respiration system 10. The escape of excess air and the operation of respiration system 10 will be hereinafter further described. The first conduit 56 will normally extend downwardly from the first orifice 32, adjacent the wearer's back (ilustrated in FIG. 1), and thence to a pressurized air source (not herein illustrated).

Returning to FIG. 2, the first conduit 56 is in communication with a circularly shaped second conduit 58. The communication between first and second conduits 56,58 is at a first portion 59 of second conduit 58 and may be by means such as "T" member 60. The second conduit 58 is adapted to release air therefrom. Air release from second conduit 58 is at a second portion 62 of the second conduit 58. Second portion 62 is preferably positioned to be below the wearer's face, and is normally opposed to the first portion 59. Such positioning provides a flow of air at the inner surface of the head enclosure opposite the wearer's face to avoid fogging thereof, and further ensures that the wearer of the respiration system 10 receives the full benefit and maximum flow of air for breathing thereof. The portion 62 preferably includes attenuating means 64 for attenuating the sound of air being released from the second conduit 58. The attenuating means 64 may be as described in U.S. Pat. No. 4,052,984, which is incorporated herein by reference.

Referring to FIGS. 2 and 4, a plurality of ties 68 extend from the upper surface 24 of cape member 20, ties 68 being useful to fasten the second conduit 58 adjacently about the circumferential edge 34.

Referring to FIGS. 2 and 4, the upper surface 24 of cape member 20 preferably includes a plurality of loops 76 which are disposed about the circumferential edge 34 and may conveniently be adjacent the ties 68. Referring to FIG. 1, the loops 76 function to be opertively associated with various types of harness systems, such as a plurality of harness straps 78. Harness starps 78 aid in retaining the respiration system 10 upon the wearer's shoulders, without restriction of arm movements or comfort. The harness system, or harness straps 78, aid in keeping the respiration system 10 close to the wearer's chest and back without flopping away therefrom, particularly during bending motions of the wearer.

Figure 6:
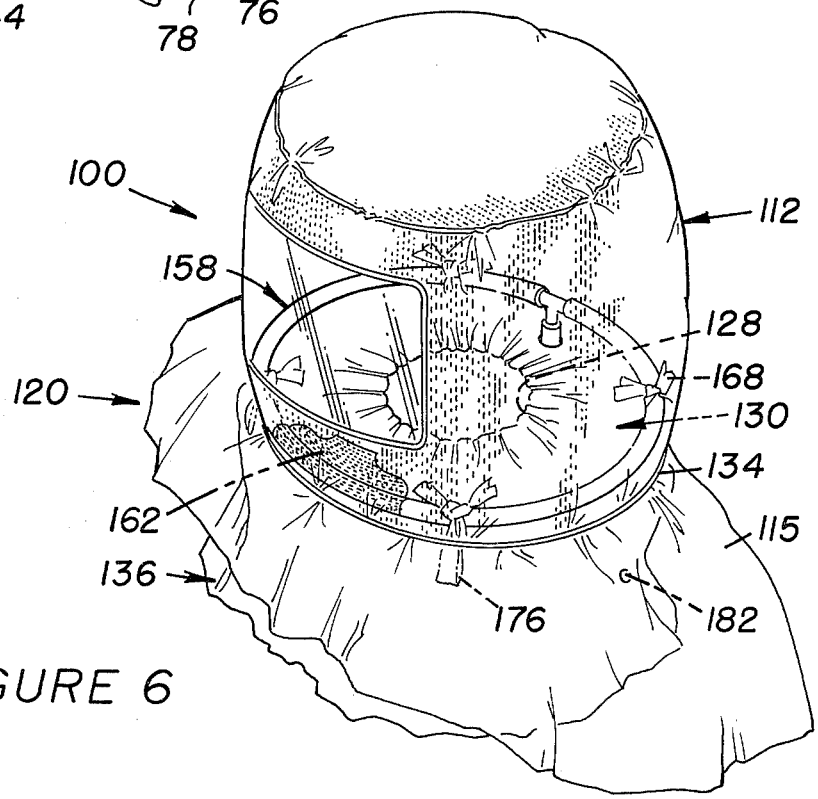

Detailed Description of the FIG. 6 Embodiment

FIG. 6 illustrates respiration system embodiment 100, wherein numerals identical to those describing the respiration system embodiment 10 depict corresponding constructions, the numerals however having 100 added thereto. The primary difference between this embodiment and the aforedescribed embodiment shown in FIGS. 1–5 is that embodiment 100 does not include the annulus 44 and elastic rings 16 and 52. Rather, embodiment 100 utilizes a circularly shaped, second conduit 158. The second conduit 158 does function to provide air release therefrom in a manner analogous to the second conduit 58 of embodiment 10. However, the second conduit 158 also functions in cooperation with ties 168 to hold inner portion 130 of cape member 120 in a radially outwardly extending ruff configuration with respect to aperture 128. Thus, the ties 168 in embodiment 100 are analogous to and function as the attachment means 51 of embodiment 10, and the second conduit 158 in embodiment 100 is analogous to and functions as the ring structure 40 of embodiment 10.

Head enclosure 112 is sealingly affixed adjacent a circumferential edge 134 of inner portion 130. Such sealing affixation is preferably permanent and airtight. The sealing affixation may be by means such as heat sealing and the like. An outer cape member 115 extends downwardly and outwardly from the sealing affixation of head enclosure 112 to circumferential edge 134. The outer cape member 115 may be considered (and formed) as being an extension of the head enclosure 112. Alternatively, the outer cape member 115 may simply be a separate piece which has been sealed about the circumferential edge 134 of the inner portion and which overlaps the outer portion 136 of cape member 120.

Operation

The above-described respiration system embodiments operate similarly. Referring to FIG. 2, the components therein illustrated will be assembled as previously described to form the ruff configuration which is illustrated by FIG. 4. The wearer will have put on protective outer clothing, such as coat 18, and the outer portion 36 of cape member 20 will be tucked under the collar area of coat 18. Harness straps 78 are attached to loops 76, and the second conduit 58 is positioned and held to the upper surface 24 of cape member 20 by ties 68. The first conduit 56 is connected to an air supply source. Gloves and foot covers can complete the protective clothing, and all seams may be taped. The air pressure of an air supply source is adjusted, and respiration air is released from the attenuating means 64 of second conduit 58 at the required flow rate and acceptably low noise levels. This constantly released air flows substantially upwardly toward and over the wearer's face for breathing thereof. Head enclosure 12 is then installed over the wearer's head and an air-tight connection is made by sealingly affixing the head enclosure 12 at shoulder portion 14 by the elastic ring 16. Thus, head enclosure 12 (specifically from the shoulder portion 14 and up) surrounds the ruff configuration of inner portion 30. Accordingly, the wearer's head, from about the neck upwards, is within a plenum of pure respiratory air.

Turning to FIGS. 2 and 5, a pair of small exhaust holes 82 are shown. Exhaust holes 82 pass between the surfaces 24,26 of cape member 20 in the outer portion 36 thereof. Exhaust holes 82 are substantially equidistant from the first orifice 32, and hence are normally adjacent each of a wearer's shoulders. As previously noted, the first conduit 56 is loosely passed through the first orifice 32. Accordingly, exhaled air can escape through the first orifice 32 from the head enclosure 12 and upper surface 24 within the ruff configuration. Turning to FIG. 5, such exhaled air then further escapes, or exhausts, through exhaust holes 82. Such exhaust is desirable to retard outward billowing and lifting of the cape member 20 during operation of respiration system 10. As previously noted, the respiration system embodiment 100 operates in an analogous manner to that of respiration system 10 and includes exhaust holes 182 over the shoulders of the wearer.

The respiration system embodiment 10 is believed to permit use of more flexible and varied head enclosure 12 constructions than does the embodiment 100. The annulus 44, cape 20 and conduits 56 and 58 of embodiment 10 are reusable, whereas all or substantially all of components for embodiment 100, except for the conduits 56 and 58, will normally be disposed of after use.

Other aspects, objectives, and advantages of this invention can be obtained from a study of the drawings, the disclosure and the appended claims.

What is claimed is:

1. A respiration system comprising:

a flexible, substantially air impervious cape member having opposed first and second surfaces and defining an aperture and a first orifice, said aperture and said orifice each passing between said surfaces;

a ring structure of sufficient size to surround said aperture and said first orifice, when said ring structure is disposed along one of said surfaces, to define an inner portion of said cape member;

attachment means for attaching said ring structure to one of said surfaces, said ring structure and attachment means co-operating to hold said inner portion in a radially outwardly extending ruff configuration with respect to said first orifice; and, an air impervious head enclosure being sealingly affixed to said cap member to surround said ruff configuration.

2. The respiration system as in claim 1 further comprising:

a first conduit operatively associated with said cape member and being of sufficient construction to channel respiration air through said first orifice from said second surface to said first surface.

3. The respiration system as in claim 1 or 2 wherein said ring structure includes an annulus, said annulus defining an exterior, circumferential groove, and said attachment means includes an elastomeric ring of sufficient construction to be engagably received within and along said groove to engage said annulus with said second surface.

4. The respiration system as in claim 3 further comprising a second conduit in communication with said first conduit adjacent said first surface at a first portion of said second conduit, said second conduit being formed substantially in a circular shape and having a second portion thereof adapted to release air therefrom.

5. The respiration system as in claim 4 wherein said air releasing second portion of said second conduit includes attenuating means for attenuating the sound of air being released from said releasing portion.

6. The respiration system as in claim 5 wherein said attenuating means is positionable to be held below a wearer's face.

7. The respiration system as in claim 1 or 2 wherein said cape member defines a pair of exhaust holes therethrough, said exhaust holes being spaced to be between said inner portion and an outer portion of said cape member and to be equidistant from said first aperture.

8. The respiration system as in claim 7 wherein said sealing affixation of said head enclosure is by an elastomeric ring of sufficient construction to be engagably received within and along said groove of said annulus.

9. The respiration system as in claim 2 wherein said ring structure comprises a second conduit in communication with said first conduit at a first portion of said second conduit, said second conduit being formed substantially in a circular shape and having a second portion thereof adapted to release air therefrom, and said attachment means attaches said second conduit to said first surface of said cape member.

10. The respiration system as in claim 9 wherein said air releasing second portion of said second conduit includes attenuating means for attenuating the sound of air being released from said air releasing portion.

11. The respiration system as in claim 10 wherein said attenuating means is positionable to be held below a wearer's face.

12. The respiration system as in claim 9 wherein said cape member has an outer portion sealingly engaged with and surrounding said inner portion, said outer portion defining a pair of exhaust holes therethrough being equidistant from said first aperture.

13. A respiration system comprising:

a flexible, substantially air impervious cape member having opposed first and second surfaces, and defining an aperture and a first orifice each passing between said surfaces, said cape member having an inner portion extending radially outwardly from said aperture, said inner portion and said aperture being formed from a cylindrical tube with open ends and an elastic circlet placed over said cylindrical tube at a mid portion thereof, said elastic circlet being of smaller diameter than that of said tube, bringing said ends of said tube together to encase said elastic circlet and sealing said ends together;

a ring structure of sufficient size to surround said aperture and said first orifice when said ring structure is disposed along one of said surfaces adjacent said inner portion of said cape member;

attachment means for attaching said ring structure to one of said surfaces, said ring structure and attachment means co-operating to hold said inner portion in a radially outwardly extending ruff configuration with respect to said aperture; and, a head enclosure being sealingly affixed to said cap member to surround said ruff configuration.

14. The respiration system as in claim 13 wherein said cape member has an outer portion sealed to said sealed ends of said inner portion, said outer portion defining a pair of exhaust holes passing therethrough and being equidistant from said first orifice.

* * * * *

UNITED STATES PATENT AND TRADEMARK OFFICE

CERTIFICATE OF CORRECTION

PATENT NO. : 4,236,514

DATED : December 2, 1980

INVENTOR(S) : ANTHONY L. MORETTI

It is certified that error appears in the above—identified patent and that said Letters Patent is hereby corrected as shown below:

Column 1, line 54 - Delete "cap" and insert --cape--.

Column 1, line 57 - Delete "cap" and insert --cape--.

Column 7, line 11 - Delete "cap" and insert --cape--.

Column 8, line 42 - Delete "cap" and insert --cape--.

Signed and Sealed this

*Eighteenth* Day of *August 1981*

[SEAL]

*Attest:*

GERALD J. MOSSINGHOFF

*Attesting Officer*

*Commissioner of Patents and Trademarks*